US006337614B1

(12) United States Patent
Tsutsui

(10) Patent No.: US 6,337,614 B1
(45) **Date of Patent: *Jan. 8, 2002**

(54) ELECTROMAGNETIC REPLY

(75) Inventor: Kazuhiro Tsutsui, Kyoto (JP)

(73) Assignee: Omron Corporation, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/565,496

(22) Filed: May 5, 2000

(30) Foreign Application Priority Data

May 6, 1999 (JP) ..... 11-125652

(51) Int. Cl.[7] ..... H01H 9/20

(52) U.S. Cl. ..... 335/160; 335/78; 335/83; 335/162; 335/202

(58) Field of Search ..... 335/159, 160, 335/161, 162, 163, 78, 83, 202; 200/50.32, 50.33, 50.34, 50.35, 50.36, 50.37

(56) References Cited

U.S. PATENT DOCUMENTS 4,816,794 A * 3/1989 Nagao et al. ..... 335/136

5,274,348 A * 12/1993 Vernier et al. ..... 335/78

FOREIGN PATENT DOCUMENTS

| | | |
|---|---|---|
| JP | 63-23755 | 2/1988 |
| JP | 4-27547 | 3/1992 |
| JP | 2522448 | 10/1996 |
| JP | 10-1622712 | 6/1998 |

* cited by examiner

*Primary Examiner*—Ramon M. Barrera
(74) *Attorney, Agent, or Firm*—Morrison & Foerster LLP

(57) ABSTRACT

Fixed terminals 60 and 80 are mounted by being engaged with the flanges of the spools of electromagnetic blocks 1 and 31 by use of a press fitting or another method, by which the flanges are joined in parallel to each other so as to join the electromagnetic blocks 1 and 31 to each other. This arrangement allows the provision of a twin type electromagnetic relay in which two electromagnetic blocks are joined in parallel to each other, the relay has a reduced number of components and a simple structure in which the electromagnetic blocks and the fixed terminals are stably joined to each other with high accuracy.

3 Claims, 8 Drawing Sheets

ELECTROMAGNETIC REPLY

BACKGROUND OF THE INVENTION

The present invention relates to a combined type electromagnetic relay such as a twin type electromagnetic relay in which a plurality of electromagnetic blocks are joined to one another. The present invention relates, in particular, to a complex type electromagnetic relay in which electromagnetic blocks are stably joined to one another with a reduced number of components.

Conventionally, there has been an electromagnetic relay that has a structure in which two electromagnetic blocks are housed in one casing and a fixed contact (Normal Open -NO- contact or Normal Close -NC- contact) which is provided for each of the electromagnetic blocks is electrically connected to a common fixed terminal. This type relay is called a twin type. If this twin type electromagnetic relay is employed, then an electrical circuit for controlling forward and reverse currents to an electric load to achieve, for example, the forward and reverse rotation of a motor or the forward and reverse operation of a solenoid can be simply constructed.

That is, for example, the fixed terminal located on the NO contact side is connected to a power line, and the fixed terminal located on the NC contact side is connected to a ground line. Further, common terminals (movable contact terminals) which are connected to the movable contacts of the respective electromagnetic blocks are separately connected to one terminal side and the other terminal side of the motor coil. Then, the coil terminal of either one of the electromagnetic blocks is electrified with an excitation current according to a switch operation or a microcomputer output for instructing the forward or reverse rotation of the motor. This arrangement allows the bidirectional electrification control of the motor coil (i.e., the forward/reverse rotation control of the motor) to be achieved.

It is to be noted that the term of "electromagnetic block" in the present specification means a sub-assembly which is consisted of a pair of basic elements each constituting an electromagnetic relay (the element including at least a movable contact, an electromagnet for effecting an electromagnetic force on the movable contact and a movable contact spring for effecting a restoration force on the movable contact).

At this type of electromagnetic relay has been known and disclosed in the prior art reference Japanese Utility Model Registration No. 2522448 or Japanese Utility Model Laid-Open Publication No. HEI 4-27547 (referred to as a "first prior art example" hereinafter), the one disclosed in the prior art reference of Japanese Patent Laid-Open Publication No. HEI 10-1622712 (referred to as a "second prior art example" hereinafter) and the one disclosed in the prior art reference of Japanse Utility Model Laid-Open Publication No. SHO 63-23755 (referred to as a "third prior art example" hereinafter).

Among these, the first prior art example and the second prior art example are each provided with a joint member (a member independent of the fundamental member such as spools and terminals) called the base, fixed block or terminal assembly for stably and accurately connecting and fastening the electromagnetic blocks to the common fixed terminal. In the third prior art example, the upper flanges of the electromagnetic blocks, spools are joined together by the fixed terminal without providing any independent joining member.

In general, with regard to the electromagnetic relay mounted on an in-car circuit board, a relay of a sealed type (i.e., a sealed type relay) is commonly used. This type is selected so as to withstand the cleaning and the like after the mounting of the circuit board and securing specified waterproof and dustproof properties. For example, the relays of the aforementioned first and second prior art reference examples are each covered with a casing that is wholly closed except for one opened side on which terminal lead portions are exposed. The opened side of the casing is further covered with a member such as the base with a slight gap, and the opened side is sealed with a seal material.

Lately, there has been and earnest demand for the reducing the size and cost of the electromagnetic relays of this type. For these purposes, a further reduction in the number of components and a denser component assembly structure become important. Accordingly, in the aforementioned second prior art example, the member which is called the base that has conventionally been the base of the assembly is removed. Futher, there is used a relay of a type such that one flange of the spool around which the electromagnet coil is wound is arranged inside the opening of the casing and this one flange is made to concurrently function as a base.

However, the relay units of the first prior art example and the second prior art example are each provided with the joint member independent of the fundamental members such as the spools and the terminals. Therefore, the relay units of the first and second prior art examples have had the disadvantage that the components and the assembly processes are increased. Then the component cost and assembling cost rise.

The relay of the third prior art example has a structure in which the electromagnetic blocks are mutually assembled by joining only the flanges located on the upper side of the spools. Therefore, with the relay of the third prior art example it is difficult to assure a high assembling accuracy of the electromagnetic blocks and a high assembling accuracy of the fixed terminal.

SUMMARY OF THE INVENTION

Accordingly, it is a principal objective of the present invention to provide a complex type electromagnetic relay in which a plurality of electromagnetic blocks are joined in parallel to one another, the relay having a reduced number of components and a simple structure in which the electromagnetic blocks and the fixed terminals are stably joined to one another with high accuracy. It is a second object of the present invention to provide a complex type electromagnetic relay with a simple structure that can be wholly sealed (for the provision of a sealed type relay).

In order to achieve the aforementioned objectives, the first inventive aspect is to provide an electromagnetic relay of a complex type comprising: a plurality of electromagnetic blocks which are arranged in parallel to one another and each of which includes an electromagnet constructed of a coil wound around a spool which has flanges at both ends, a movable contact to be displaced in one direction by an effect of an electromagnetic force of one electromagnet, a movable contact spring for creating a restoration force toward the opposite direction on the movable contact, a common terminal connected to the movable contact and coil terminals connected to the coil; fixed contacts that are arranged on either side or oppositely on both sides of what in the direction of displacement of each movable contact and have the state of the connection changed relative to the movable contacts according to the displacement of the movable contacts; common fixed terminals connected to the respective fixed contacts each being arranged on an identical side relative to the movable contacts; and a common displacement regulating member that is provided when the fixed contacts are arranged on either side of the movable contacts so as to be arranged on the other side of the movable contacts as the need arises and regulates the displacement of the movable contacts toward the other side, the electromagnetic blocks being integrally joined to one another with the flanges located at both ends of the spools joined parallel to one another by mounting in an engagement manner the fixed terminals or the displacement regulating member on the flanges located on one side of the spools or the flanges located on the other side of the spools.

According to the electromagnetic relay of the present invention, the necessary fixed terminal and displacement regulating function as a joint member as well as joining the flanges which are located on both sides of the spool. With this arrangement, the stable high-accuracy assembling of the two electromagnetic blocks and the stable high-accuracy assembling of the fixed terminals with the electromagnetic blocks are achieved with a minimum number of components without providing any other members. As a result, there can be obtained the excellent effect of allowing the cost reduction to be achieved in terms of both the component cost and assembling cost while maintaining high reliability of the relay in a satisfactorily assembled state.

The electromagnetic relay of the second inventive aspect is characterized in that the engagement is put into effect by inserting or press-fitting projecting portions provided in a plurality or portions of the fixed terminals or the displacement regulating member into recess portions provided on the flanges located on one side of the spools or the flanges located on the other side of the spools.

The above arrangement allows the mounting to be easily achieved and allows the assembling cost to be further reduced, as compared with the case where the fixed terminals are mounted in an engagement manner on the flanges by, for example, crimping.

The electromagnetic relay of the third inventive aspect is characterized in that all elements except for the connecting end portions of the terminals are covered with a casing which is opening on one end side, the joined flanges located on one side of the spools have a shape and dimensions approximately equal to a shape and dimensions of the opening portion of the casing and are arranged inside the opening portion of the casing, the connecting end portions are led from the opening side of the casing, and the opening of the casing is closed with a gap that can be sealed with a seal member by the lead portions of the connecting end portions and the joined flanges located on one side of the spools.

The above arrangement also allows the obtainment of the effect that a high-reliability sealed relay of a complex type (a twin type, for example) is capable of easily being sealed with the seal member, without causing the deficiency of the excessive inflow of the seal member to the inside, and can be easily manufactured at low cost.

BRIEF DESCRIPTION OF THE DRAWINGS

FIG. 2A shows the completely assembled state of one electromagnetic block and FIG. 2B shows a state in which two electromagnetic blocks are joined parallel to each other (the state being referred to as a "joined state" hereinafter);

DETAILED DESCRIPTION OF THE PREFERRED EMBODIMENTS

An example of a twin type electromagnetic relay according to an embodiment of the present invention will be described below with reference to the accompanying drawings. Reference is first made to the structure of an electromagnetic block that constitutes the twin type electromagnetic relay of the present example with reference to FIG. 1 through FIG. 2B.

the opened side (the lower side in FIG. 1 through FIG. 7) of a casing 90 (shown in FIG. 7) which will be described later is referred to as a casing opened side hereinafter according to circumstances, while the ceiling side (the upper side in FIG. 1 through FIG. 7) of the casing 90 described later is referred to as a casing ceiling side according to circumstances. The axial direction (the vertical direction in FIG. 1 through FIG. 7) of the coil is referred to as a vertical direction according to circumstances, while the direction perpendicular to the axial direction of the coil is referred to as a lateral direction according to circumstances.

Figure 1:
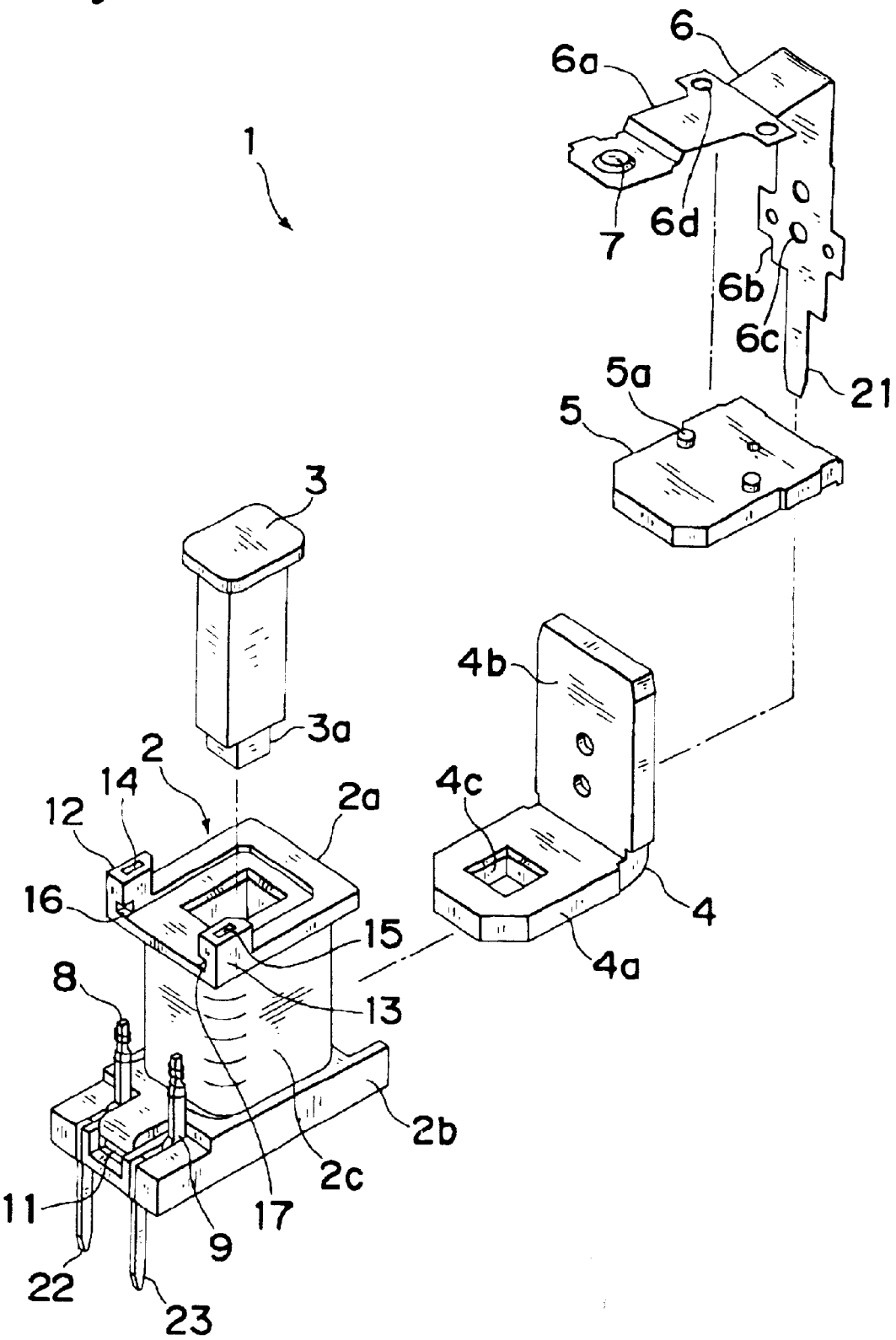
FIG. 1 is an exploded perspective view showing the structure of one electromagnetic block according to an electromagnetic relay of the present invention.
Figure 2A:
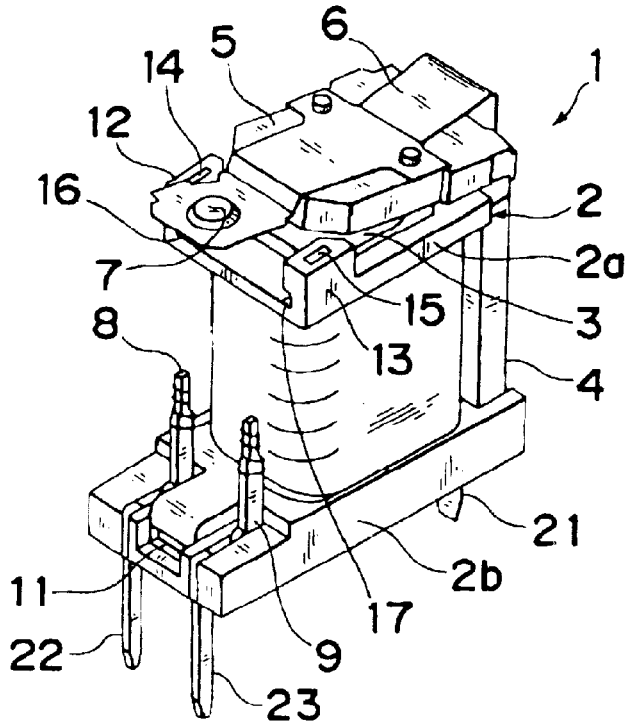
FIGS. 2A and 2B are perspective views of electromagnetic blocks, where

As shown in FIG. 1, and electronmagnetic block 1 is provided with a spool 2 which has flanges 2*a* and 2*b* at both the upper and lower ends thereof and around which a coil 2*c* is wound, an iron core 3 is inserted in a vertical through hole formed through the spool 2, an L-shaped yoke 4 is joined to a casing opening side portion of the iron core 3 and serves as a path through which lines of magnetic force pass, a movable iron armature 5 of which the root side is joined to the yoke 4 and of which the front end side is made to swing by being attracted to the iron core 3 when the coil is electrified, and L-shaped movable contact spring 6 whose horizontally plate-shaped portion 6*a* which is located on the casing ceiling side is a swingable leaf spring and is mounted on an exterior surface side (on the upper surface side in the figure) of the movable iron armature 5, a movable contact 7 mounted on the tip of the movable contact spring 6 and a coil terminal 8 and a coil terminal 9 that are connected to the lead wires of the coil 2*c*.

Besides these members, the electromagnetic relay has the other fundamental elements of a fixed contact (i.e., an NC contact with which the movable contact 7 comes in pressure contact with when the coil is not electrified or a NO contact with which the movable contact 7 comes in pressure contact when the coil is electrified) and a fixed terminal whose one end is mounted with the fixed contact. However, these elements, which are to be collectively mounted on each electromagnetic blocks as described later, will be described separately later.

The yoke 4 has a horizontally plate-shaped portion 4*a* and a vertically plate-shaped portion 4*b*. The horizontally plate-shaped portion 4*a* is inserted in a recess (not shown) formed on the exterior surface (the lower surface in FIG. 1) of the flange 2*b* located on the casing opened side of the spool 2 and is joined to the tip of the iron core 3 by crimping. The vertically plate-shaped portion 4*b* extends from the recess of the flange 2*b* on the casing depth side in the axial direction of the coil.

The movable contact spring 6 is a spring for applying a restoration force on the movable iron armature 5 and the movable contact 7. The movable contact spring 6 also functions as a movable contact terminal (i.e., a common terminal) for connecting the movable contact 7 to a specified circuit conductor. This movable contact spring 6 has the aforementioned horizontally plate-shaped portion 6*a* and a vertically plate-shaped portion 6*b*. A projection (not shown) formed on the rear surface of the yoke 4 (vertically plate-shaped portion 4*b*) is inserted in a through hole 6*c* formed through the vertically plate-shaped portion 6*b*. Then, the tip of the projection is crimped, and the movable contact spring 6 is fastened to the rear surface of the yoke 4 (vertically plate-shaped portion 4*b*).

A through hold 6*d* is formed through the horizontally plate-shaped portion 6*a* of the movable contact spring 6. Then, a projection 5*a* formed on the movable iron armature 5 is inserted in the through hole 6*d* and crimpled, by which the movable iron armature 5 is fastened to the movable contact spring 6.

Then, a strip-shaped portion located on the casing opened side of the movable contact spring 6 and the casing opened side end portions of the coil terminals 8, 9 extend so as to make their tips project downwardly from the flange 2*b* in the figure (i.e., outwardly from the opened end of the casing 90 described later) and form connection terminal portions 21, 22 and 23, respectively on the terminals. The connection terminal portions 21, 22 and 23 are used for connecting the movable contact 7 and the lead wires of the coil 2*c* to the specified circuit conductors of a printed circuit board or the like.

A slit-shaped recess 11 is formed on the front (the side on which the coil terminals 8 and 9 are mounted) of the flange 2*b* which is located on the casing opening side of the spool 2, and a projection 71 of a coil terminal 60 described later can be press-fit in the recess. Projections 12 and 13 that project toward the casing ceiling side are formed in both left- and right-hand end positions on the front end side of the flange 2*a* located on the casing ceiling side of the spool 2. Slit-shaped recesses 14 and 15 are formed on the top surface (the upper surface in the figure) of the projections 12 and 13. The projections of a press-fit portion 86, 87 of a fixed terminal 80 which are described later can be press fit in the slit-shaped recesses 14 and 15. Recesses 16 and 17 are formed on the root end inner surfaces of these projections 12 and 13. The corner portions 66 and 69 of a fixed terminal 60 which are described later are inserted in the recesses 16 and 17.

Further, a bracket-shaped notch 18 (shown in FIG. 8) is formed at the center of the rear end of the flange 2*b* of the spool 2, and the root end of the connection terminal portion 21 of the movable contact spring 6 is inserted in the above-mentioned cut portion. An L-shaped notch 19 (shown in FIG. 8) is formed on the front side of the exterior surface of the flange 2*b*. Then, the root side (the casing opened side end portion of the side surface plate-shaped portion 63 which is described later) of a connection terminal portion 73 of a fixed terminal 60 which is described later is inserted in the above-mentioned cut portion.

Assembling the principal components with the spool 2 can be easily performed as follow. For example, as shown in FIG. 1, the horizontally plate-shaped portion 4*a* of the yoke 4 is inserted into the recess of the flange 2*b*, positioning the yoke 4 with the spool 2 appropriately. Next, the iron core 3 is inserted into the spool 2 from the casing depth side, and a calking projection 3*a* located at the tip is made to penetrate a hole 4*c* formed through the yoke 4 (horizontally plate-shaped portion 4*a*). Then, the iron core 3 and the yoke 4 are fastened to the spool 2 by calking the tip of the calking projection 3*a*. Subsequently, the movable contact spring 6 (is connected to the movable iron armature 5) are attached to the spool 2 mounted with the yoke 4 and the iron core 3. Then, by crimping the projection of the yoke 4 in a condition in which the projection is inserted in the through hole 6*c* formed through the movable contact spring 6, the movable contact spring 6 is mounted (together with the movable iron armature 5) on the yoke 4. It is to be noted that the "crimping" generally means, for example, the partial plastic deformation of a member (mainly a metal member) for the purpose of fixing two or more members to one another. However, normally, in regard to the electromagnetic relay of this type, the mounting method for fastening members to one another by inserting and penetrating a projection provided on one member into a hole or an opening provided through the other member and thereafter deforming the tip of the projection by means of a press machine or the like so as the widen the diameter of the projection.

Figure 2B:
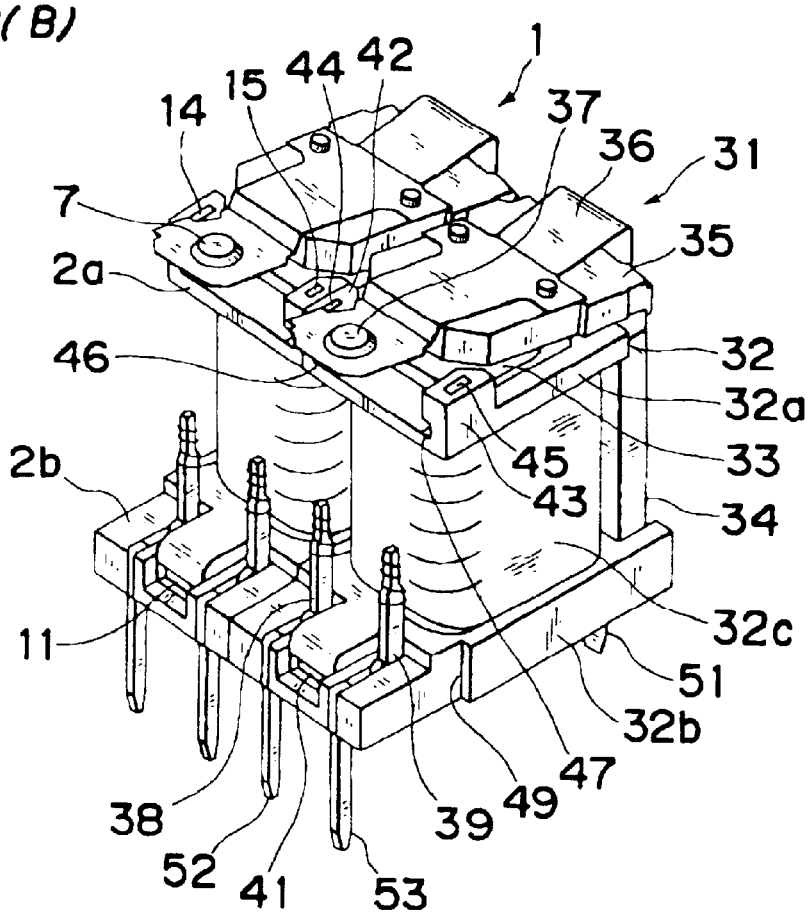

As shown in FIG. 2B, the other electromagnetic block 31 is provided with a spool 32 which has flanges 32*a* and 32*b* at both the upper and lower ends thereof, and around which a coil 32*c* is wound. The block 31 also includes; an electromagnetic iron core 33 inserted in a vertical through hole formed through this spool 32, an L-shaped yoke 34 that is joined to a casing opened side portion of the iron core 33 and serves as a path through which lines of magnetic force pass, a movable iron armature 35 of which the root side is joined to the yoke 34 and of which the front end side is made to swing by being attracted to the iron core 33 when the coil is electrified, an L-figured movable contact spring 36 of which the front end is fastened to the exterior surface side (the upper surface side in the figure) of the movable irom armature 35 and of which the root end is fastened to the rear surface of the yoke 34, a movable contact 37 mounted on the tip of the movable contact spring 36, and a coil terminals 38, 39 that are connected to the lead wires of the coil 32*c*, respectively.

Figure 8:
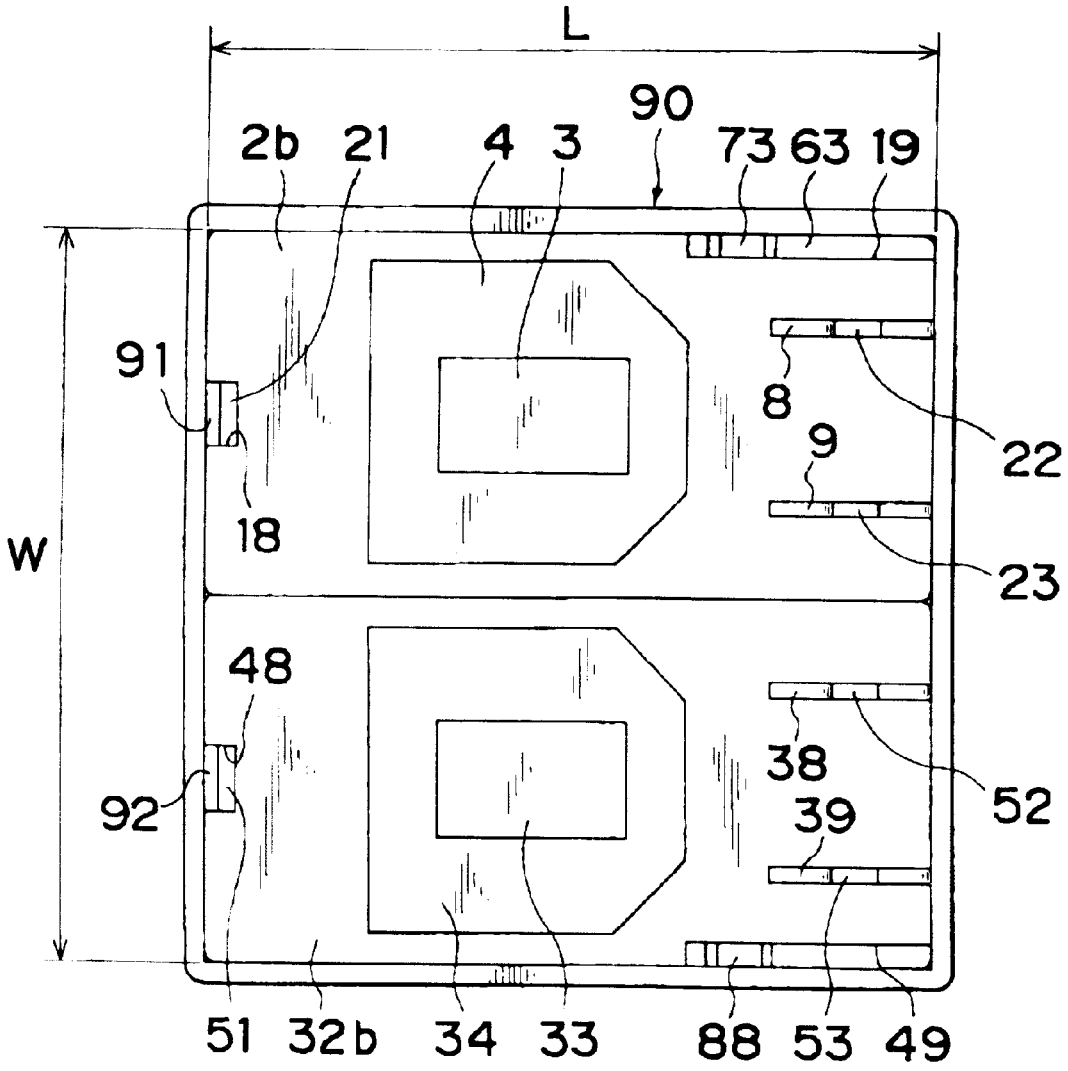
FIG. 8 is a plan view showing the casing opening side of the electromagnetic relay.

As shown in FIG. 2B and FIG. 8, recesses 41, 44, 45, 46 and 47 and notches 48 and 49 are formed in the spool 32 of the electromagnetic block 31 similar to the aforementioned block 1.

It is to be noted that the electromagnetic block 31 has the same construction as that of the aforementioned electromagnetic block 1 except that a portion of the flange 32*b* positioned on the casing opening side of the spool 32 is laterally symmetrical to the flange 2*b* of the electromagnetic block 1, and therefore, no detailed description is provided for the electromagnetic block 31.

The structure of the fixed terminals and the assembly structure of the fixed terminals (i.e., the joint structure of the aforementioned electromagnetic blocks) will be described next with reference to FIGS. 3 through 6.

Figure 3:
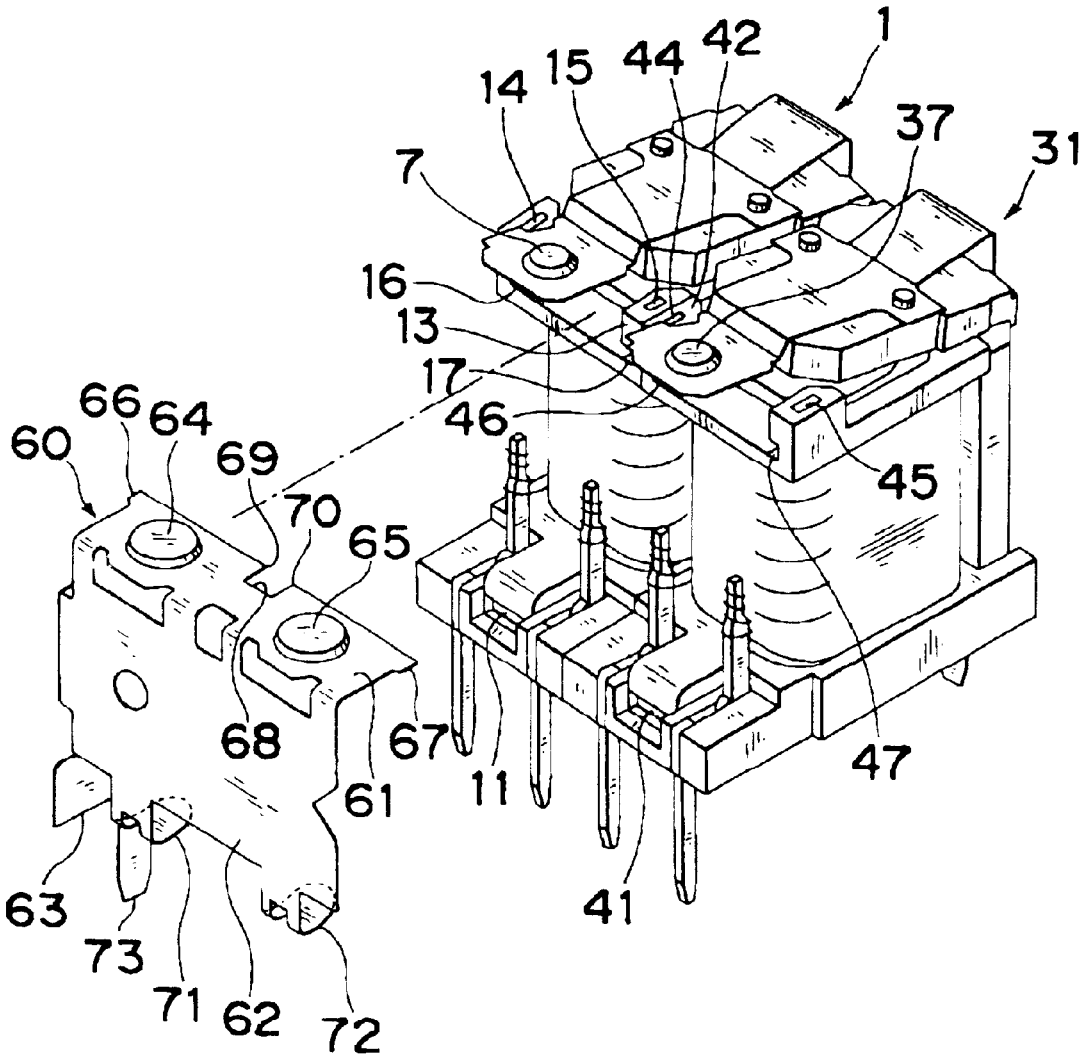
FIG. 3 is a perspective view showing a fixed terminal located on the NO contact side and the assembling process of the terminal.

As shown in FIG. 3, a fixed terminal 60 is a wide shape member and is obtained by, for example, a press working (cutting and bending) a thin plate material having an electrical conductivity. That is, the fixed material 60 has a horizontally plate-shaped portion 61 located on the casing depth side, a vertically plate-shaped portion 62 that extends roughly perpendicularly from the horizontally plate-shaped portion 61 toward the casing opening side and a side surface plate-shaped portion 63 extends roughly perpendicularly from one side edge of this vertically plate-shaped portion 62 toward the inside.

NO contacts 64 and 65 are fixed to the horizontally plate-shaped portion 61 of this fixed terminal 60 by, for example, crimping in the positions corresponding to the movable contacts 7 and 37 of the electromagnetic blocks 1 and 31. Corner portions 66 and 67 are concurrently inserted into the recesses 16 and 47 of the electromagnetic blocks 1 and 31 which are formed on both sides of the leading edges of the horizontally plate-shaped portion 61. A cut portion 68 is formed at the center of the leading edge of the horizontally plate-shaped portion 61. This cut portion 68 can be coupled with the projection 13 of the electromagnetic block 1 and the projection 42 (projection provided with a recess 44) of the joined electromagnetic blocks 1 and 31, respectively. Then, the corner portion 69 and 70 of this cut portion 68 can be concurrently inserted into the recesses 17 and 46 of the electromagnetic blocks 1 and 31, respectively.

Further, projections 71 and 72 which are inwardly bent roughly perpendicularly are provided on the lower end side of the vertically plate-shaped portion 62 of the fixed terminal 60. These projections 71 and 72 can be concurrently press-fit into the recesses 11 and 41 of the electromagnetic blocks 1 and 31, respectively, put in the joined state. A strip-shaped portion located on the casing opening side of the side surface plate-shaped portion 63 of the fixed terminal 60 has its leading end extending so as to project downwardly of the flange 2*b* (i.e., outwardly of the opening end of a casing 90 described later) as shown in the figures forming a connection terminal portion 73. This connection terminal portion 73 is used for collectively connecting the NO contacts 64 and 65 to the specified circuit conductors of a printed circuit board or the like.

Figure 4:
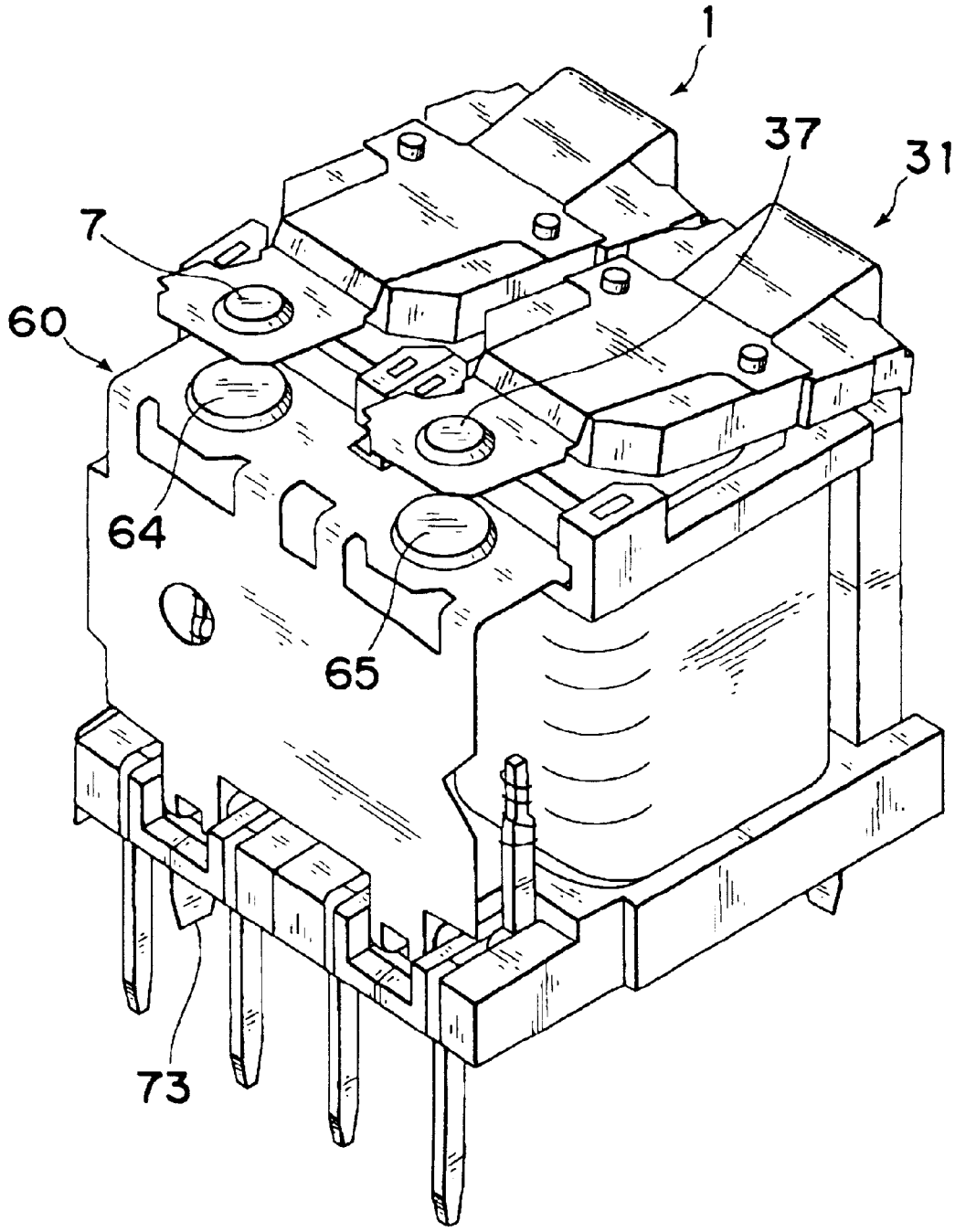
FIG. 4 is a perspective view showing a state in which the fixed terminal located on the NO contact side is assembled with the electromagnetic blocks.

Then, as shown in FIG. 3, the fixed terminal 60 can be easily mounted on the electromagnetic blocks 1 and 31 by attaching in the lateral direction. Further, by mounting the fixed terminal 60, the flanges (the flanges 2*a* and 32*a* located on the casing ceiling side and the flanges 2*b* and 32*b* located on the casing opened side) of the electromagnetic blocks 1 and 31, respectively, are joined to each other. Then, the corner portions 66, 67, 69 and 70 are inserted into the corresponding recesses 16, 47, 17 and 46, while the projections 71 and 72 are press-fit into the recesses 11 and 41, respectively. With this arrangement, as shown in FIG. 4, the fixed terminal 60 is stably mounted in a state in which the NO contacts 64 and 65 are arranged in specified positions on the lower side of the movable contacts 7 and 37 opposite to the movable contacts. Then, by the mounting of this fixed terminal 60, the flanges of the electromagnetic blocks 1 and 31 are connected to each other on both sides. The connection terminal portion 73 of the fixed terminal 60 is arranged inside the cut portion 19 (shown in FIG. 8).

Figure 5:
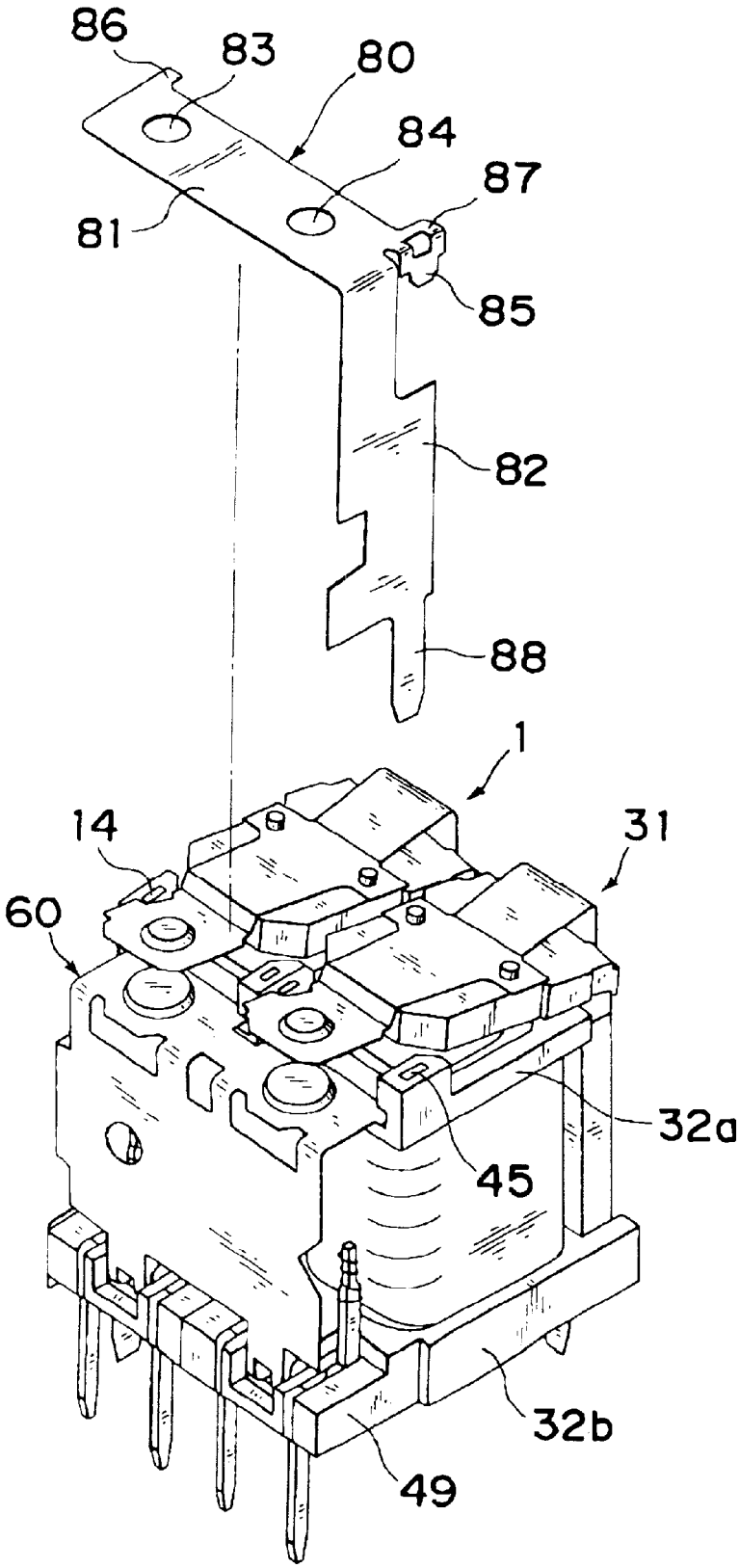
FIG. 5 is a perspective view showing a fixed terminal located on the NC contact side and the assembling process of the terminal.

Next, as shown in FIG. 5, the fixed terminal 80 located on the NC contact side is a L-shaped member obtained by bending a conductive strip-shaped material roughly at right angles. That is, the fixed terminal 80 has a horizontally plate-shaped portion 81 located on the casing depth side and a verically plate-shaped portion 82 that extends roughly perpendicularly from the horizontally plate-shaped portion 81 toward the casing opening side. NC contacts 83 and 84 are fixed to the horizontally plate-shaped portion 81 by, for example, crimping in the positions corresponding to the movable contacts 7 and 37 of the electromagnetic blocks 1 and 31, respectively. Press-fit portions 86 and 87 provided with a projection that downwardly projects shown in FIG. 5 (only the projection on the root side is indicated by the reference numeral 85 in FIG. 5) are formed on the tip side and the root side of the horizontally plate-shaped portion 81). The projections of these press-fit portions 86 and 87 can be concurrently press-fit into the recesses 14 and 45 of the electromagnetic blocks 1 and 31, respectively. A strip-shaped portion that belongs to the fixed terminal 80 is located on the casing opening side of the vertically plate-shaped portion 82 and has its tip extending so as to project downwardly from the flanges 2*b* and 32*b* shown in FIG. 5 (i.e., outwardly from the opening end of the casing 90 described later), and constituting a connection terminal portion 88. This connection terminal portion 88 is used for connecting the NC contacts 83 and 84 to the specified circuit conductors of a printed circuit board or the like.

Figure 6:
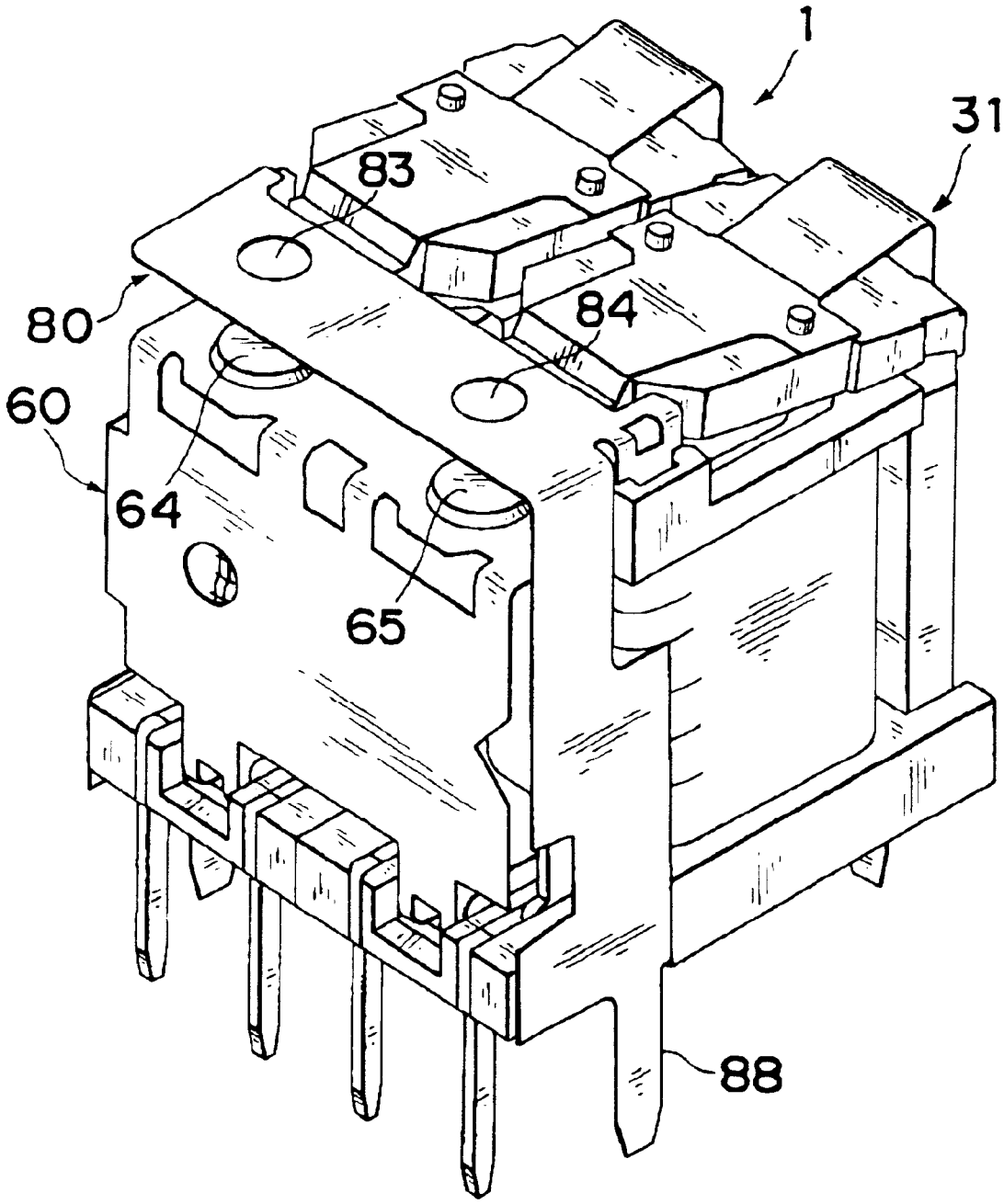
FIG. 6 is a perspective view showing a state in which the fixed terminal located on the NC contact side is assembled with the electromagnetic blocks.

This fixed terminal 80 can be easily mounted by being moved in the vertical direction with respect to the electromagnetic blocks 1 and 31, as shown in FIG. 5. The flanges 2*a* and 32*a* located on the casing ceiling side of the electromagnetic blocks 1 and 31 are also joined to each other by the mounting of the fixed terminal 80 on the flanges 2*a* and 32 *a*. That is, shown in FIG. 5, the fixed terminal 80 is moved in the vertical direction with respect to the electromagnetic blocks 1 and 31, and the projections of the press-fit portions 86 and 87 are press-fit into the recesses 14 and 45. As shown in FIG. 6, the fixed terminal 80 is stably mounted in a state where the NC contacts 83 and 84 are arranged in specified positions on the upper side of the movable contacts 7 and 37, shown in FIG. 6, opposite to the movable contacts. Further, the flanges 2*a* and 32*a* located on the casing depth side of the electromagnetic blocks 1 and 31 are also joined to each other by the mounting of the fixed terminal 80. In this case, the connection terminal portion 88 of the fixed terminal 80 is arranged inside the cut portion 49 in the transverse direction.

Next, the final assembly and the structure obtained after the final assembling of the present relay will be described with reference to FIGS. 7 and 8. As described above, the relay of the present embodiment is constructed of a sub-assembly in which the two electromagnetic blocks 1 and 31 are joined to each other by the mounting of the fixed terminals 60 and 80 (FIG. 6). Then, the sub-assembly is covered with the casing 90 as shown in FIG. 7, and thereafter, the opened side of the casing 90 is sealed with a sealing member (not shown) made of a thermosetting resin (epoxy resin, for example) to achieve the present relays assembly.

Figure 7:
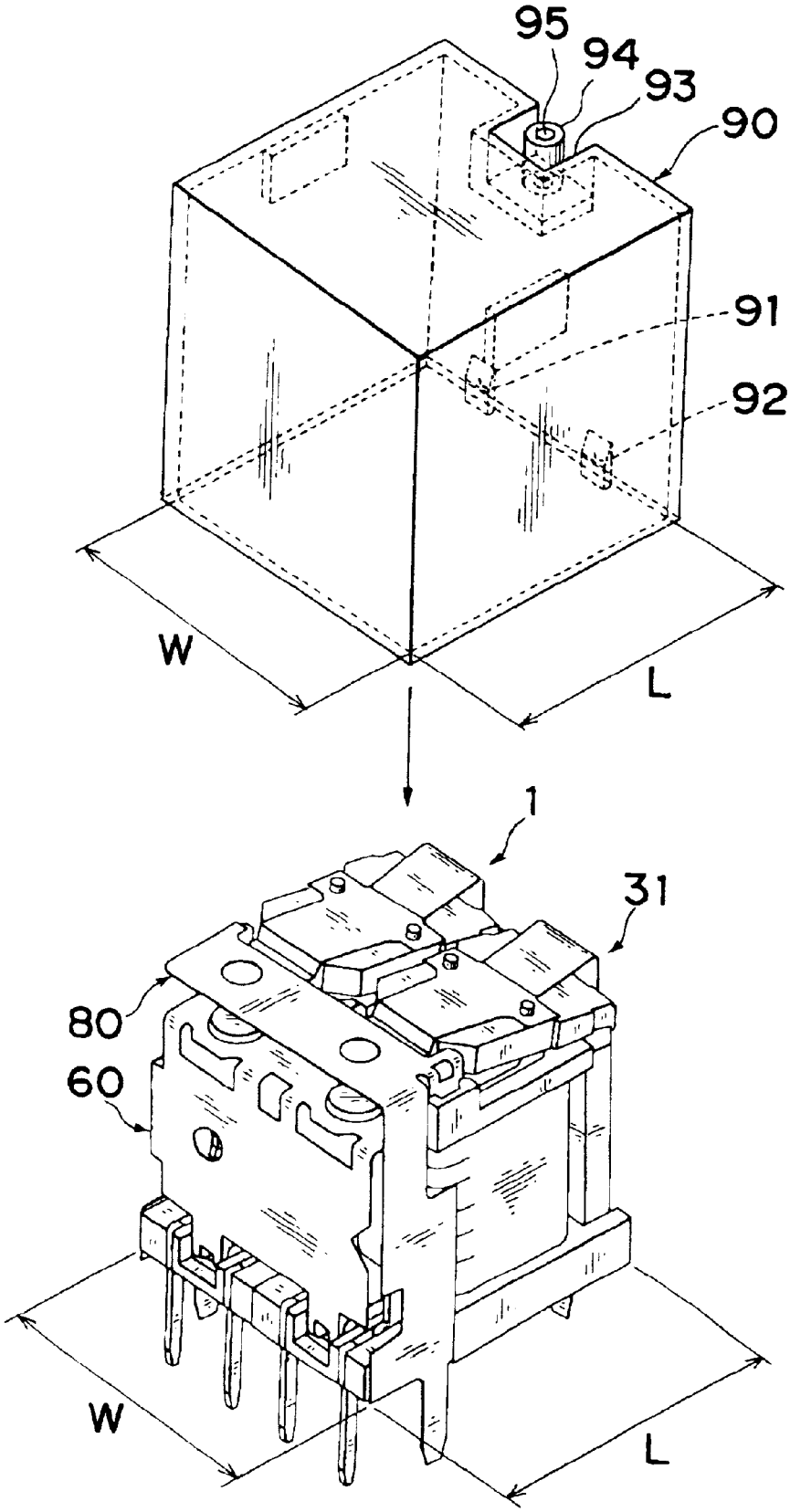
FIG. 7 is a perspective view showing the joined electromagnetic blocks obtained after the assembling and a casing.

The casing 90 has a hollow box shape having an opening on one side (the lower side in FIG. 7). Then, the vertical and horizontal dimensions L and W of the inner surface of the rectangular opening roughly coincide with the overall exterior dimensions of the flanges 2*b* and 32*b* located on the casing opening side of the sub-assembly. Further, the joined flanges 2*b* and 32 *b* that belong to the electromagnetic blocks 1 and 31, which are located on the casing opening side, are made to have a shaped and dimensions roughly equal to the shape and dimensions of the opening portion of the casing 90 except for the lead portions of the connections terminal portions 21, 22, 23, 51, 52, 53, 73 and 88 which lead from the opened side of the casing 90. With this arrangement, the flanges 2*b* and 32*b* can be arranged inside the opening portion of the casing 90. That is, when the sub-assembly is covered by the casing 90, then the whole opening of the casing 90 is closed by the lead portions of the connection terminal portions and the joined flanges 2*b* and 32*b* of the electromagnetic blocks with a gap that can be sealed with the seal member, as shown in FIG. 8. In this case, projections 91 and 92, to be fit into the cut portions 18 and 48 (cut portions in which the root side of the connection terminal portions 21 and 51 to be used for the movable contacts are inserted) formed through the flanges 2*b* and 32*b*, are formed on the inner surface of the opening of the casing 90 in a manner that the projections abut against the rear surfaces on the root side of the connection terminal portions 21 and 51. This arrangement is adopted for some reasons in terms of manufacturing, so that an appropriate gap is formed by closing the larged gaps of the cut portions 18 and 48, which are formed deeper than the thickness of each of the connection terminal portions 21 and 51 with these projections 91 and 92.

A recess 93 is provided on the surface (the upper surface in FIG. 7) opposite to the opened side of the casing 90, and a cylindrical projection 94 is provided on the bottom surface of the recess 93. Then, a through hole 95 for making the inside and outside of the casing 90 communicate with each other is provided along the center line of this cylindrical projection 94 and functions as a ventilation hole which is described later.

The seal member is filled normally as follows. That is, in a state in which the casing opening side of the relay assembled as shown in FIGS. 7 and 8 faces perpendicularly upward, a specified amount of seal member (not yet cured) is dripped or flowed down toward the casing opening side. Then, the seal member is made to appropriately enter the gaps on the casing opening side by the natural flow due to gravity and the capillary phenomenon, and a seal layer having a flat surface is formed inside the casing opening. Thereafter, the seal member is cured by placing the whole relay in a curing vessel in which the seal member is heated to, for example, a temperature not lower than the curing temperature of the seal member and the temperature is maintained for a specified time. Through these processes, the casing opening side is sealed, by which the relay is sealed with the connection terminal portions projecting from the seal portion.

It is necessary to let the air inside the casing escape in order to prevent a pressure increase inside the casing due to heating when curing the seal member. Accordingly, the through hole 95 of the casing 90 functions as a ventilation hole for the above purpose in the present example. Then, in the case of the sealed type relay, to completely seal the relay it is necessary to seal the ventilation hole after the curing of this seal member. However, this sealing work can be easily performed by thermoforming or adhesive stuffing. In this example, it is proper to thermoform the tip of the projection 94 so as to close the through hole 95 with respect to the outside of the casing. This kind of ventilation hole can also be provided through, for example, the flanges 2*b* and 32*b* on the casing opening side instead of being provided through the casing 90.

As described above, according to the relay of the present example, the electromagnetic blocks 1 and 31 are concurrently joined to each other with their flanges tightly joined to each other on both sides by the mounting of the fixed terminals 60 and 80. With this arrangement, the stable high-accuracy mutual assembling of the two electromagnetic blocks and the stable high-accuracy assembling of the fixed terminals with the electromagnetic blocks can be achieved with the minimum number of components without providing any other member. In particular, cost reduction can be achieved in terms of both the component cost and assembling cost while maintaining the high reliability of the relay in the satisfactory assembled state.

In particular, according to the relay of the present embodiment, the mounting of the fixed terminals (i.e., the joining of the electromagnetic blocks) is achieved by inserting or press-fitting the projections provided in the plurality of portions of the fixed terminals into the respective recesses provided on the flanges. Therefore, the mounting is easier than the case where the fixed terminals are mounted by being engaged with the flanges by, for example, crimping, and this allows the assembling cost to be further reduced.

In the present embodiment, all the elements except for the connection terminal portions of the terminals are covered by the casing 90, having the opening on one side. Further, the joined flanges 2*b* and 32*b* are made to have shapes and dimensions roughly equal to the shapes and dimensions of the opening in this casing 90. Accordingly, the flanges 2*b* and 32*b* are arranged inside the opening in the casing 90, and the opening in the casing 90 is wholly closed by the lead portions of the connection terminal portions and the flanges 2*b* and 32*b* with a gap that can be sealed with the seal member. As a result, this arrangement can also produce the effect that a high-reliability twin type sealed relay is capable of easily being seald with the seal member without causing the deficiency of the excessive inflow of the seal member to the inside and can be easily manufactured at low cost.

The present invention is not limited to the above embodiment. The aforementioned embodiment is an example obtained by applying the present invention to the twin type electromagnetic relay of a c-contact type (a type having both an a-contact and a b-contact). However, for example, the present invention can also be similarly applied to an a-contact type that has only an a-contact (NO contact) or a b-contact type that has only a b-contact (NC contact). In the above cases, the fixed contact and the fixed terminal located on either side are unnecessary and are removable. However, depending on the case, a member for regulating the displacement of the movable contact (i.e., a displacement regulating member) is necessary in place of the removed fixed contact and fixed terminal. For example, if the a-contact type is employed in the aforementioned embodiment, then the fixed contacts 83 and 84 and the fixed terminal 80 become unnecessary. However, depending on the case, it is required to provide a member that regulates the upward displacement (displacement due to the restoration force to the movable contact springs 6 and 36) in FIG. 7, similar to, for example, the horizontally plate-shaped portion 81 of the fixed terminal 80. If this kind of displacement regulating member is provided, then there may be a structure in which the flanges of the electromagnetic blocks are joined to each other by the mounting of the displacement regulating member, similarly to, for example, the fixed terminal 80.

It is to be noted that the present invention is not limited to the twin type electmagnetic relay of the aforementioned embodiment in which the two electromagnetic blocks are joined to each other and can be similarly applied to a complex type electromagnetic relay in which a greater number of electromagnetic blocks are similarly joined to one another.

There may be provided a plurality of portions of fixed terminals or displacement regulating member to be engaged with the spool flanges by press-fitting or the like for the purpose of increasing the stability or a similar purpose instead of one engagement portion per flange. For example, in the aforementioned embodiment, the projections to be press-fit in the recesses 15 and 44 provided for the flanges 2*a* and 32*a* located on the casing depth side may be additionally provided on the fixed terminal 80.

What is claimed is:

1. An electromagnetic relay of a combined type, comprising:

a plurality of electromagnetic blocks which are arranged in parallel to one another, each electromagnetic block comprising an electromagnet comprising a coil wound around a spool which has flanges at both ends, a movable contact to be displaced in a direction by an effect of an electromagnetic force of the electromagnet, a movable contact spring for creating a restoration force on the movable contact, a terminal which is connected to the movable contact, and coil terminals which are connected to the coil;

fixed contacts, which are arranged on either side of the movable contacts in the direction of displacement of each movable contact and change the state of the connections for the movable contacts according to the displacement of the movable contacts; a common fixed terminal which is connected to the fixed contacts arranged on a side of the movable contacts; and a common displacement regulating member which restricts the displacement of each movable contact toward a side opposite the fixed contacts, and a casing including an opening on an end side and projections formed on an inner surface of the opening of the casing, the opening being of approximately a shape and dimension of the flanges, which flanges are arranged inside the opening of the casing, where a connection from a lead portion of the common fixed terminal and flange portions located on one of the sides of the spool close the opening, leaving a gap that is sealed by a seal member and the projections engage the flanges, wherein the electromagnetic blocks are integrally joined to one another with the flanges, which are located at both ends of the spools, being joined in parallel to one another by mounting the fixed terminals or the displacement regulating member to flange portions located on one side of the spool, and wherein all elements except for the connecting end portions of the terminals are covered by the casing.

2. An electromagnetic relay as claimed in claim 1, wherein the electromagnetic blocks are joined in parallel to one another by inserting or press-fitting projecting portions provided in a plurality of locations of the common fixed terminal or the displacement regulating member into recess portions provided on the flange portions located on one of the sides of the spool.

3. An electromagnetic relay as claimed in claim 2, wherein the common fixed terminal comprises cut portions which engage projections formed on the electromagnetic blocks.

* * * * *